US005493800A

United States Patent [19]

Chinitz

[11] Patent Number: 5,493,800

[45] Date of Patent: Feb. 27, 1996

[54] EXPANDABLE STRETCHING FRAME WITH CLADDING AND BEARING MECHANISMS

[76] Inventor: Clyde J. Chinitz, 283 Baltic St., Brooklyn, N.Y. 11217

[21] Appl. No.: 261,778

[22] Filed: Jun. 20, 1994

[51] Int. Cl.[6] ..... D06C 3/08

[52] U.S. Cl. ..... 38/102.4; 38/102.91; 160/381

[58] Field of Search ..... 38/102.1, 102.61, 38/102.8, 102.91; 101/127.1; 160/374.1, 375, 376, 381; 292/351; 403/362

[56] References Cited

U.S. PATENT DOCUMENTS

| | | | |
|---|---|---|---|
| 6,731 | 9/1849 | Bryant | 160/374.1 |
| 1,916,023 | 6/1933 | Shull | 160/374.1 |
| 2,149,985 | 3/1939 | Tepper | 160/374.1 |
| 2,938,698 | 5/1960 | Johnson | 403/362 X |
| 3,479,072 | 11/1969 | Kosar | 403/362 |
| 3,625,274 | 12/1971 | Johnson | 38/102.1 |
| 3,651,854 | 3/1972 | Terna | 160/374.1 |
| 3,914,887 | 10/1975 | Newman | 38/102.8 |
| 3,924,343 | 12/1975 | Johnson | 38/102.1 |
| 3,949,802 | 4/1976 | Buratovich | 160/374.1 |
| 4,179,830 | 12/1979 | Lamb | 38/102.8 X |
| 4,301,853 | 11/1981 | Vidal | 160/374.1 |
| 4,419,825 | 12/1987 | Miyamoto | 33/169 R |
| 4,519,151 | 5/1985 | Johnson | 160/374.1 |
| 4,549,596 | 10/1985 | Staro | 160/374.1 |
| 5,033,529 | 7/1991 | Koschade | 38/102.91 X |
| 5,076,162 | 12/1991 | Goin | 101/127.1 |
| 5,113,611 | 5/1992 | Rosson | 38/102.7 |
| 5,133,140 | 7/1992 | Frey | 38/102.91 |
| 5,271,171 | 12/1993 | Smith | 38/102.5 |

FOREIGN PATENT DOCUMENTS

| | | | |
|---|---|---|---|
| 0012051 | of 1895 | United Kingdom | 292/351 |
| 2020535 | 11/1992 | WIPO | 38/102.91 |

*Primary Examiner*—C. D. Crowder
*Assistant Examiner*—Ismael Izaguirre
*Attorney, Agent, or Firm*—Dilworth & Barrese

[57] ABSTRACT

An expandable frame assembly is provided for supporting and stretching a fabric which includes a plurality of frame portions together defining the periphery of the frame assembly and each having opposed ends and an interior bore extending therethrough, and a plurality of connective expansion members each including first and second extension portions. Each extension portion is slidably mounted within an interior bore of one of the frame portions and has a planar contact surface thereon. An adjustable bearing mechanism is mounted in each end of the plurality of frame portions. Each bearing mechanism has a spherical bearing surface for engaging the planar contact surface of the expansion member proximate thereto to exert a bearing force thereupon. Cladding strips are provided on an outer surface portion of each frame portion for securing a piece of fabric to the frame assembly.

17 Claims, 4 Drawing Sheets

Fig. 1
(Prior Art)
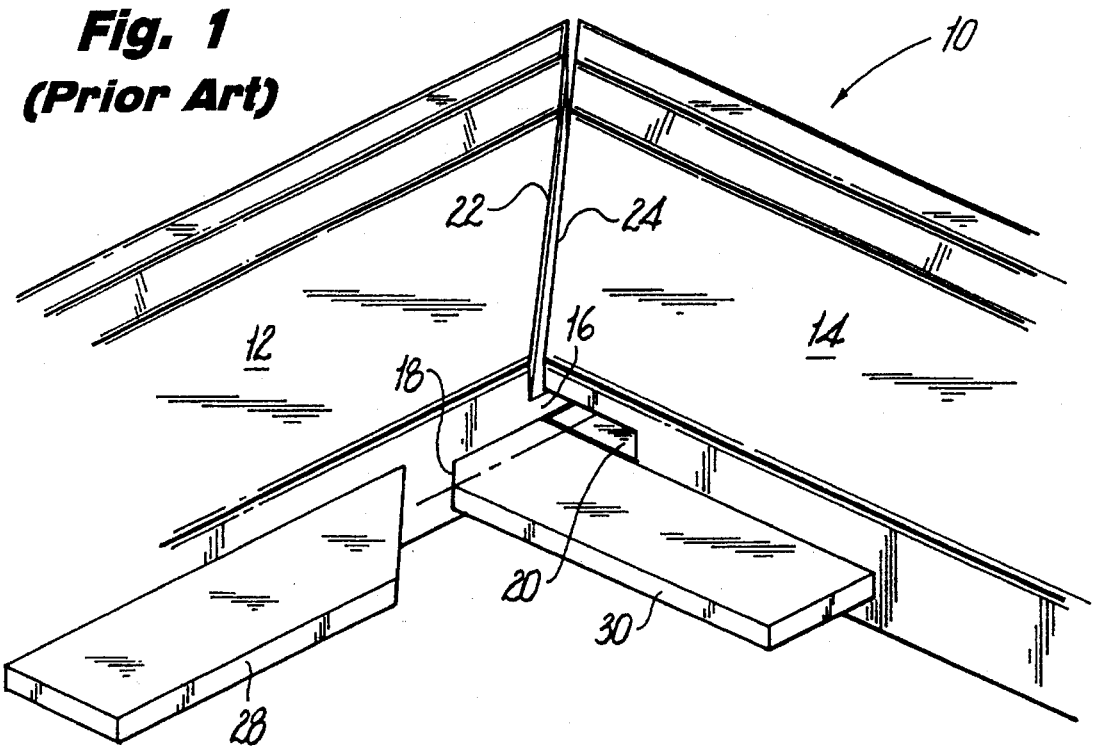
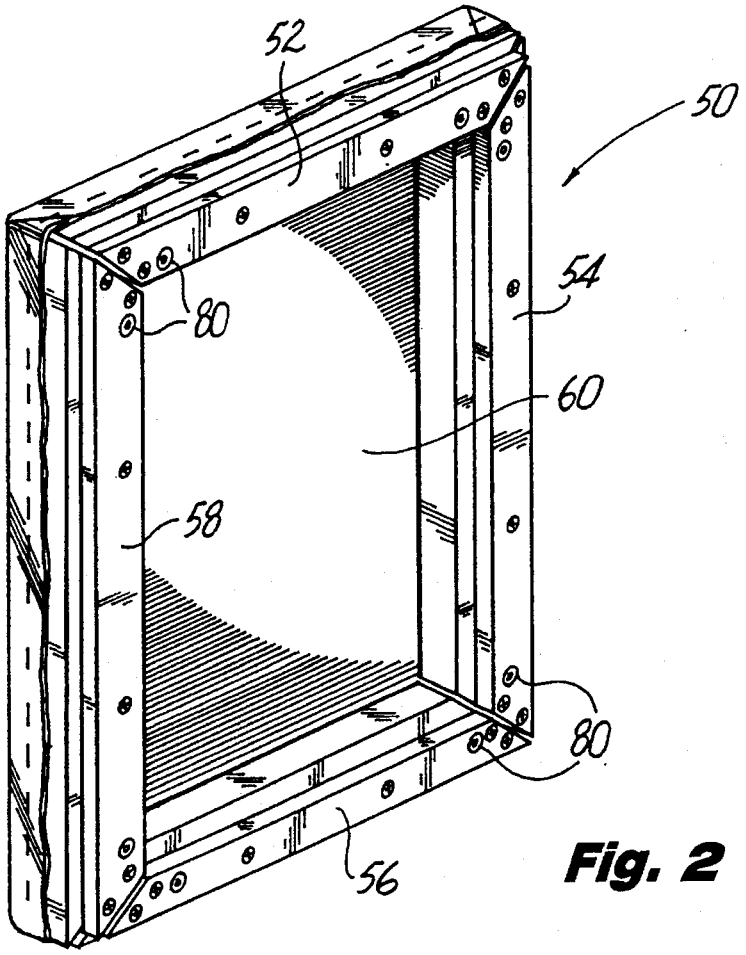
Fig. 2

Fig. 6
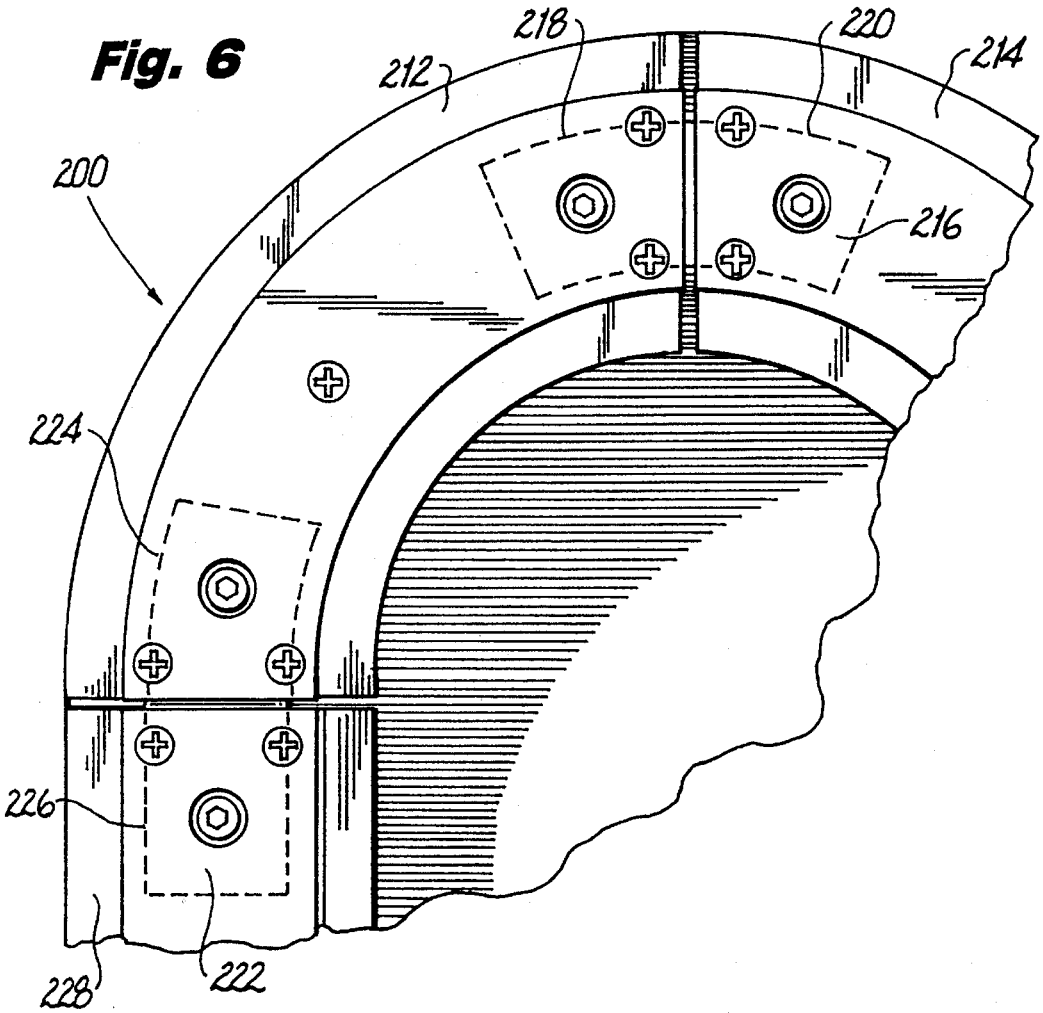
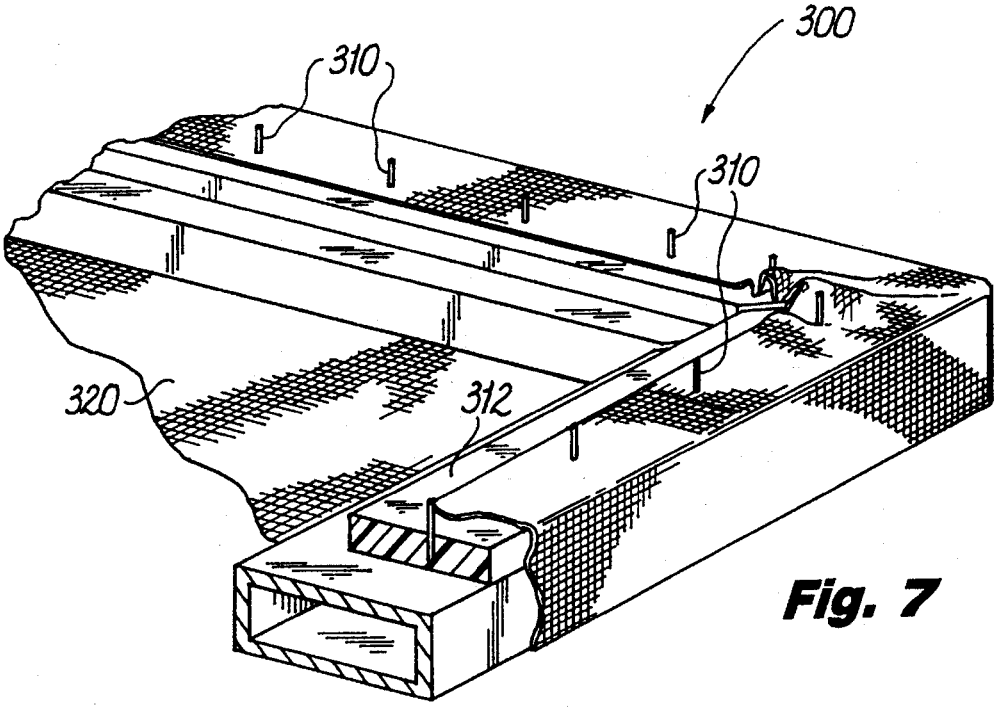
Fig. 7

EXPANDABLE STRETCHING FRAME WITH CLADDING AND BEARING MECHANISMS

BACKGROUND OF THE INVENTION

1. Field of the Invention

This invention relates to a method and apparatus for supporting and tensioning a fabric, and more particularly to an expandable frame assembly for supporting and stretching canvas and the like.

2. Description of the Related Art

Conventional stretchers are generally in the form of a wooden frame onto which a piece of canvas or other material is secured by staples or tacks. Wedges are forced into the corners of the wooden frame to vary the spacing between the frame portions such that the material supported thereon is tautly stretched in all directions.

Other types of canvas stretching frames are also known. An example of an early canvas stretching frame is disclosed in U.S. Pat. No. 1,916,023 to A. E. Shull which employs a series of threaded coupling elements mounted on threaded bolt members. Rotation of the coupling elements serves to spread the frame portions to stretch the canvas supported thereon. A later canvas stretching frame disclosed in U.S. Pat. No. 4,301,853 to Vidal includes a plurality of threaded tensioning rods which are each biased by a compression spring. The tensioning rods can be adjusted to vary the dimensions of the frame. Another canvas stretching frame disclosed in U.S. Pat. No. 4,549,596 to Staro includes inserts which form angles at the corners of the frame. Slide blocks are provided on the frame with adjustable tensioning screws for exerting a force against the frame to stretch the canvas supported thereon.

Other types of expandable frames are also known in the art which are particularly configured to support a fabric mesh for use during a silk screening operation. Such prior art stretching frames are disclosed, for example, in U.S. Pat. Nos. 5,076,162 to Goin; 5,113,611 to Rosson; and 5,271,171 to Smith.

It would be beneficial to provide a stretching frame which includes a simple mechanism for adjusting the relative positions of the frame portions and which is readily adaptable to support and tension either canvas or silk screening material.

SUMMARY OF THE INVENTION

The subject invention is directed to an expandable frame for supporting and stretching a piece of fabric. The expandable frame includes a plurality of frame portions together defining the periphery of the frame assembly and each having an interior bore extending therethrough and opposed ends, and a plurality of connective expansion members each including first and second extension portions which have planar contact surfaces thereon and which are dimensioned to be slidably mounted within an interior bore of one of the frame portions.

An adjustable bearing mechanism is mounted in each end of the frame portions. Each bearing mechanism has a spherical bearing surface for engaging the planar contact surface of the expansion member proximate thereto to exert a beating force thereupon. In one embodiment of the subject invention, each adjustable bearing mechanism includes a threaded member and an associated spherical bearing member. In another embodiment of the subject invention, the adjustable beating mechanism includes a threaded member terminating in a spherical tip portion for engaging a planar contact surface of an expansion member.

Fabric fastening means is provided on an outer surface portion of each frame portion for attaching a piece of fabric to the frame assembly. In one embodiment of the subject invention, the fabric fastening means is adapted to secure canvas to the frame assembly and comprises a pliable cladding material for receiving staples or the like. In another embodiment of the subject invention, the fabric fastening means is adapted to secure silk screening material to the frame assembly and comprises a plurality of spaced apart outwardly extending brads for engaging the material.

The subject invention is further directed to a method of stretching and tensioning a fabric supported on a frame assembly including a plurality of frame portions together defining the periphery of the frame assembly and each having an interior bore extending therethrough and opposed ends, a plurality of connective expansion members each slidably mounted within the interior bores of adjacent frame portions and having a planar contact surface thereon, and an adjustable bearing mechanism mounted adjacent each end of the frame portions and having a bearing surface for engaging the planar contact surface of an expansion member proximate thereto to exert a bearing force thereupon.

The method includes the steps of initially adjusting a first bearing mechanism adjacent a first end of a first frame portion to decrease the bearing force exerted thereby upon an expansion member proximate thereto, urging a second frame portion adjacent the first end of the first frame portion in a radially outward direction to stretch and tension a piece of material supported on the frame assembly, and subsequently adjusting the first bearing mechanism to increase the bearing force exerted thereby upon the expansion member proximate thereto so as to maintain the relative position of the first and second frame portions.

Further features of the subject invention will become more readily apparent from the following detailed description of the invention taken in conjunction with accompanying drawings.

BRIEF DESCRIPTION OF THE DRAWINGS

So that one skilled in the art to which the subject invention appertains will better understand how to make and use the invention, preferred embodiments of the expandable stretching frame will be described hereinbelow with reference to the drawings wherein:

FIG. 1 is a perspective view of a section of a conventional wooden canvas stretching frame;

FIG. 2 is a perspective view of a canvas stretching frame constructed in accordance with a preferred embodiment of the subject invention;

FIG. 6 is an elevational view of another canvas stretching frame constructed in accordance with a preferred embodiment of the subject invention; and FIG. 7 is a perspective view of a corner section of another stretching frame constructed in accordance with a preferred embodiment of the subject invention which is adapted to support fabric for silk screening.

DETAILED DESCRIPTION OF THE PREFERRED EMBODIMENTS

Figures 3, 4:
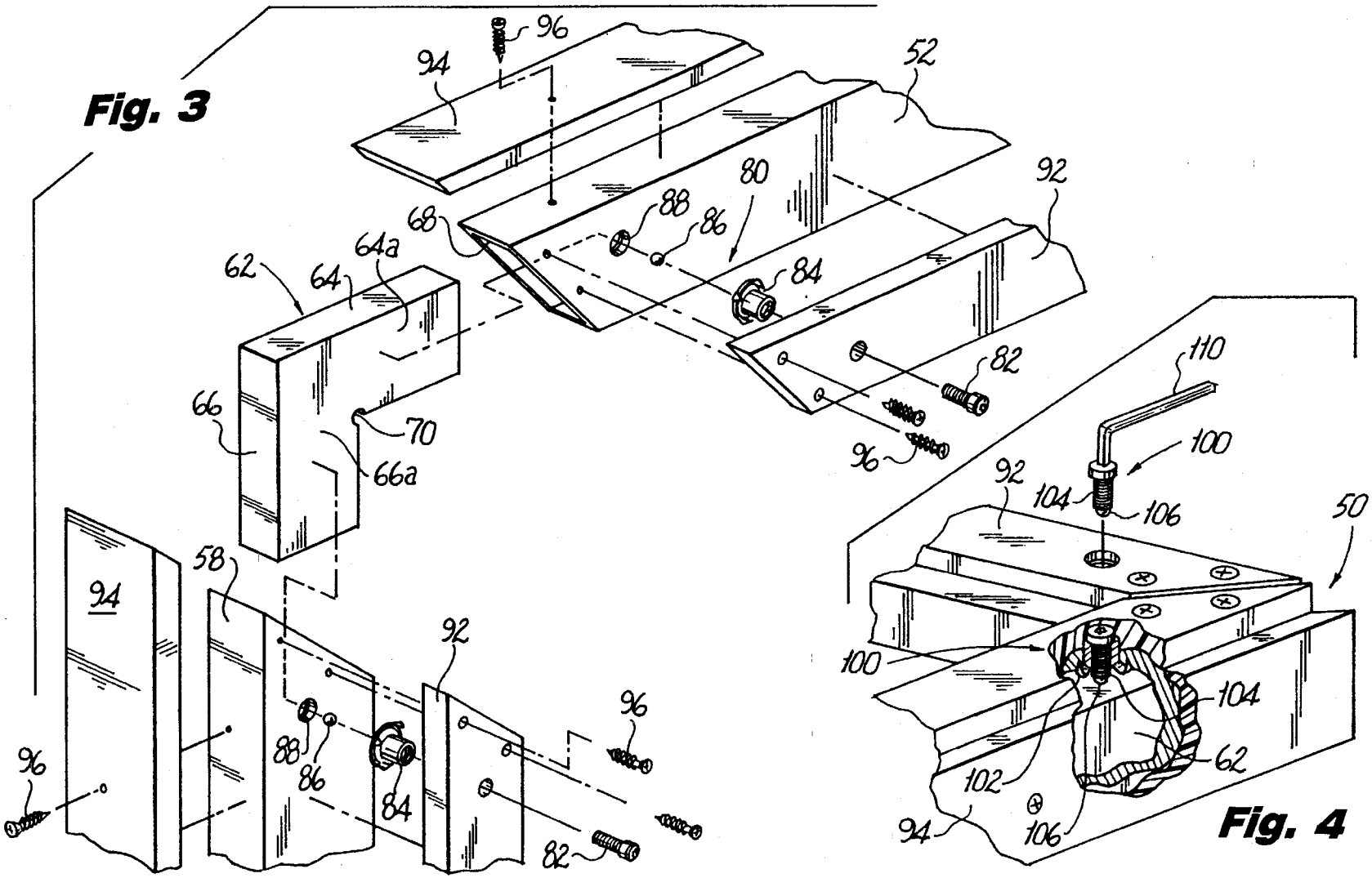
FIG. 3 is an exploded perspective view of a corner section of the canvas stretching frame of FIG. 2.
FIG. 4 is a perspective view in partial cross-section of a corner section of the canvas stretching frame of FIG. 2 with a one piece adjustable bearing mechanism employed therein.

Referring now to the drawings wherein like reference numerals identify similar structural elements of the subject invention, there is illustrated in FIG. 1 a corner section of a conventional wooden canvas stretching frame designated generally be reference numeral 10. Frame assembly 10 includes frame portions 12 and 14. Frame portion 12 has a tongue 16 and a groove 18 while frame portion 14 has a similar tongue which is not shown and a groove 20. The tongue and groove sections are configured to be slidably engaged such that the mitered edges 22 and 24 of frame portions 12 and 14 are brought into contact, and an area of each groove 18 and 20 remains open. Wooden key members 28 and 30 are urged into grooves 18 and 20 to expand the dimensions of frame assembly 10 and stretch a canvas supported on the frame portions. However, over a period of time, the wooden key members can warp or loosen as the canvas is worked and its characteristics change, thereby decreasing the tension on the canvas.

Referring now to FIG. 2, there is illustrated an expandable stretching frame assembly constructed in accordance with a preferred embodiment of the subject invention and designated generally by reference numeral 50. In brief, frame assembly 50 includes four elongate frame portions 52, 54, 56, and 58 which are configured to support a piece of canvas 60. Preferably, the frame portions are constructed from aluminum tubing having a rectangular cross-sectional configuration defining four exterior surfaces thereabout. It is envisioned however that other materials of construction with alternate geometric configurations can be employed. As will be discussed in detail hereinbelow, the relative position of each frame portion of frame assembly 50 can be altered to vary the tension on canvas 60.

Referring to FIG. 3, each corner of frame assembly 50 includes a generally L-shaped expansion fitting 62 having first and second extension portions 64 and 66 which are dimensioned and configured to be slidably mounted within the frame portions. For example, extension portion 64 of expansion fitting 62 is dimensioned and configured to be slidably mounted within the interior bore 68 of frame portion 52. The outer dimensions of extension portion 64 are slightly less than the dimensions of the interior bore 68 of frame portion 52, thus, an interference fit is achieved between the two structural members.

Preferably, expansion fittings 62 are constructed from a high density polymeric material such as, for example, nylon or teflon, so as to reduce friction between the expansion fittings and the frame portions of stretching frame 50. As best seen in FIG. 3, expansion fitting 62 is formed with a notch 70 at the junction between extension portions 64 and 66 to accommodate the inner walls of the frame portions with which it is associated during assembly. Extension portions 64 and 66 define planar contact surfaces **64*a* and 66*a*, respectively, for interacting with an associated bearing mechanism 80**.

Referring to FIGS. 2 and 3, an adjustable bearing mechanism 80 is mounted adjacent each end of frame portions 52–58 for imparting a bearing force on the expansion member 62 proximate thereto. Each bearing mechanism 80 includes an adjustable fitting 82, a threaded socket 84 for supporting adjustable fitting 82, and a spherical bearing member 86 disposed within a bearing seat 88 for engaging expansion member 62. Each threaded socket 84 is engaged within a cladding strip 92 which extends along the outer wall of each frame portion. The cladding strip 92, as well as the cladding strip 94 on the upper wall of each frame portion, are adapted to receive staples or tacks to secure the canvas 60 to at least one exterior surface of frame assembly 50. The cladding strips can be formed of rubber, plastic, or a similar material, and are fastened to the frame portions of stretching frame 50 by a plurality of threaded fasteners 96.

Another bearing mechanism constructed in accordance with a preferred embodiment of the subject invention is illustrated in FIG. 4 and is designated generally by reference numeral 100. Bearing mechanism 100 includes a threaded socket 102 and an adjustment fitting 104 terminating in a spherical tip portion 106 formed integral therewith. Preferably, fitting 104, as well as fitting 82 of bearing mechanism 80, are configured to be selectively adjusted by a wrench 110. However, fittings 104 and 82 can have slotted heads that may be selectively adjusted utilizing a screw driver or similar tool.

Figure 5:
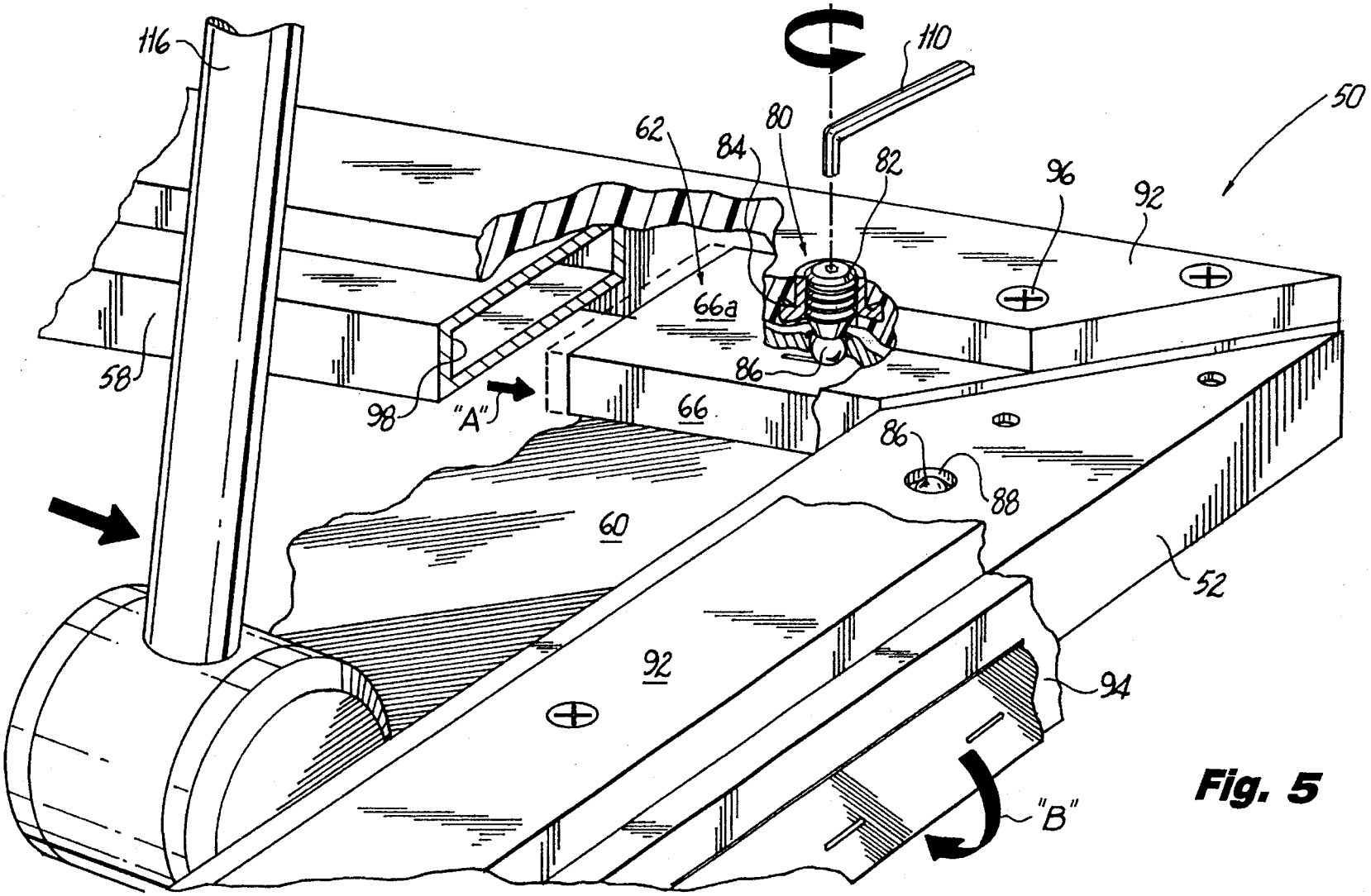
FIG. 5 is an enlarged perspective view in partial cross-section of a corner section of the canvas stretching frame of FIG. 2 illustrating the manner in which the frame is expanded to stretch the canvas supported thereon.

Referring now to FIG. 5, when canvas 62 has been secured to frame assembly 50 by staples 114, for example, the relative position of the frame portions can be easily adjusted by the user. Initially, the user decreases the bearing force imparted by spherical bearing member 86 on the planar contact surface **66*a* of expansion member 62 by adjusting fitting 82 using a wrench 110. Thereafter, using a mallet 116, the user strikes frame portion 52 adjacent the adjusted bearing mechanism 80, to urge frame portion 52 radially outward. At such a time, extension portion 66 translates within the interior bore 98 of frame portion 58 in the direction of frame expansion indicated by arrow "A". Then, using wrench 110, fitting 82 is tightened to increase the bearing force exerted by bearing member 86 on contact surface 66*a*, to maintain the relative position of frame portions 52 and 58 and the tension on canvas 60. In addition, as a result of the frame expansion, the tensioned canvas 60 generates a rotational component of force on frame portion 52 in the direction indicated by arrow "B" so as to further secure the relative position of frame portions 52 and 58**.

A section of another canvas stretching frame assembly is illustrated in FIG. 6 and is designated generally by reference numeral 200. Frame assembly 200 includes arcuate frame portions 212 and 214. An expansion fitting 216 having arcuate extension portions 218 and 220 is employed to operatively connect frame portions 212 and 214. Similarly, an expansion fitting 222 having an arcuate extension portion 224 and an elongate extension portion 226 is employed to operatively connect arcuate frame portion 212 and elongate frame portion 228. Other geometric configurations of the canvas stretching frame of the subject invention are also envisioned.

A section of another stretching frame assembly is illustrated in FIG. 7 and is designated generally by reference numeral 300. Frame assembly 300 is adapted for use in a silk screening operation and is constructed in substantially the same manner as frame assembly 50 in that it includes a plurality of frame portions, a plurality of connective expansion fittings, and a plurality of associated adjustable bearing mechanisms. However, frame assembly 300 differs from frame assembly 50 in that a plurality of spaced apart brads 310 extend outwardly from the cladding strips 312 attached to the outer surface of each frame portion. The spaced apart brads 310 are provided to engage silk screening material 320 to support such material on the frame assembly.

Although the subject invention has been described with respect to preferred embodiments, it will be readily apparent to those having ordinary skill in the art to which it appertains that changes and modifications may be made thereto without departing from the spirit or scope of the subject invention as defined by the appended claims.

What is claimed is:

1. An expandable frame assembly for supporting fabric comprising:

a) a plurality of frame portions together defining the periphery of said frame assembly, each frame portion having opposed ends, an interior bore extending at least partially therethrough, and a plurality of exterior surfaces defined thereabout;

b) a plurality of connective expansion members each including first and second extension portions having planar contact surfaces thereon, each extension portion dimensioned and configured for reception in the interior bore of one of said plurality of frame portions;

c) an adjustable bearing mechanism disposed adjacent each end of each of said plurality of frame portions and having a bearing surface for engaging a planar contact surface of the expansion member proximate thereto;

d) cladding means mounted on at least one of said plurality of exterior surfaces of each of said plurality of frame portions, each bearing mechanism secured within said cladding means: and e) fabric fastening means mounted on another of said plurality of exterior surfaces of each of said plurality of frame portions for fastening a piece of fabric to said frame assembly.

2. An expandable frame assembly as recited in claim 1, wherein each adjustable bearing mechanism includes a spherical bearing surface for engaging a planar contact surface of said expansion member.

3. An expandable frame assembly as recited in claim 2, wherein each adjustable bearing mechanism includes a threaded member and an associated spherical bearing member.

4. An expandable frame assembly as recited in claim 2, wherein each adjustable bearing mechanism includes a threaded member terminating in a spherical tip portion.

5. An expandable frame assembly as recited in claim 1, wherein said frame portions are elongated and have a substantially rectangular cross-sectional configuration.

6. An expandable frame assembly as recited in claim 5, wherein said extension portions of said expansion member are elongated and have a substantially rectangular cross-sectional configuration.

7. An expandable frame assembly as recited in claim 1, wherein said frame portions and said extension portions of said expansion member are generally arcuate in configuration.

8. An expandable frame assembly as recited in claim 1, wherein said means for fastening a piece of fabric to said frame assembly comprises a cladding material attached to the outer surface of each of said frame portions for receiving fasteners.

9. An expandable frame assembly as recited in claim 1, wherein said means for fastening a piece of fabric to said frame assembly comprises a plurality of spread apart outwardly depending brads for engaging said fabric.

10. An expandable frame assembly for supporting and stretching fabric comprising:

a) a plurality of frame portions together defining the periphery of said frame assembly, each frame portion having opposed ends, an interior bore extending therethrough, and a plurality of exterior surfaces defined thereabout;

b) a plurality of connective expansion members each including first and second extension portions having planar contact surfaces thereon, each extension portion dimensioned and configured to be slidably mounted within the interior bore of one of said frame portions;

c) an adjustable bearing mechanism disposed adjacent each end of each of said plurality of frame portions, each bearing mechanism having a spherical bearing surface for engaging the planar contact surface of the expansion member proximate thereto at a single point to exert a bearing force thereupon;

d) a cladding strip mounted on one of said plurality of exterior surfaces of each of said plurality of game portions, each bearing mechanism secured within a cladding strip; and e) a fabric fastening strip mounted on another of said plurality of exterior surfaces of each of said plurality of frame portions for securing a piece of fabric to said frame assembly.

11. An expandable frame assembly as recited in claim 10, wherein said fabric fastening means comprises a polymeric cladding material attached to the outer surface of each frame portion for receiving fasteners.

12. An expandable frame assembly as recited in claim 10, wherein said fabric fastening means comprises a plurality of spaced apart outwardly extending brads for engaging said fabric.

13. An expandable frame assembly as recited in claim 10, wherein each adjustable bearing mechanism includes a threaded member and a spherical bearing member.

14. An expandable frame assembly as recited in claim 10, wherein each adjustable bearing mechanism includes a threaded member terminating in a spherical engaging tip.

15. An expandable frame assembly as recited in claim 10, wherein said plurality of frame portions are elongate in configuration and each of said expansion members are generally L-shaped in configuration.

16. An expandable frame assembly as recited in claim 10, wherein said periphery of said frame assembly is polygonal in configuration.

17. An expandable frame assembly as recited in claim 10, wherein said periphery is curvilinear in configuration.

* * * * *